United States Patent [19]

Potter

[11] 4,394,972

[45] Jul. 26, 1983

[54] FUEL INJECTION NOZZLES

[75] Inventor: James C. Potter, London, England

[73] Assignee: Lucas Industries PLC, Birmingham, England

[21] Appl. No.: 367,803

[22] Filed: Apr. 12, 1982

[30] Foreign Application Priority Data

Apr. 14, 1981 [GB] United Kingdom ..... 8111783

[51] Int. Cl.[3] ..... F02M 61/00; B05B 1/32

[52] U.S. Cl. ..... 239/453; 239/456; 239/533.12

[58] Field of Search ..... 239/533.2–533.7, 239/533.8–533.12, 584, 452, 453, 456, 459, 541, 438, 439, 444, 445

[56] References Cited

U.S. PATENT DOCUMENTS 2,063,709 12/1936 Taylor ..... 239/453

FOREIGN PATENT DOCUMENTS 835818 4/1952 Fed. Rep. of Germany ..... 239/453

2842398 4/1979 Fed. Rep. of Germany ... 239/533.3

*Primary Examiner*—Andres Kashnikow

*Assistant Examiner*—Mary McCarthy

[57] ABSTRACT

A fuel injection nozzle for supplying fuel to an internal combustion engine includes an outwardly opening valve member having a head which co-operates with a seating formed on a tubular member. The head is lifted from the seating to allow fuel flow to the assciated engine. The tubular member is also slidable within a bore and defines orifices which are exposed beyond the bore to allow fuel flow to the engine before the valve head is lifted from the seating. Improved atomization of the fuel at low pressure is therefore obtained.

10 Claims, 5 Drawing Figures

FUEL INJECTION NOZZLES

This invention relates to fuel injection nozzles for supplying fuel to internal combustion engines and of the kind comprising a body defining a chamber, a fuel inlet to said chamber, an outwardly opening valve member extending within said chamber, a head carried by the valve member for co-operation with a seating and resilient means located in the chamber and acting to urge the valve head into contact with the seating the arrangement being such that when fuel under pressure is supplied to said chamber, the pressure acting upon said valve member lifts the head from the seating to allow flow of fuel from said chamber in the form of a spray.

It is essential for the efficient operation of the engine with which the nozzle or nozzles are associated, that proper atomisation of the fuel should take place. It is known to shape the head of the valve member so that the area of the orifice through which the fuel flows varies in accordance with the axial position of the valve member. This form of nozzle is difficult to produce because of the great accuracy which is required to form the nozzle head and the surrounding portion of the body which together define the orifice. Another form of nozzle has slots formed in the valve member the ends of the slots being uncovered by a portion of the body to a greater extent as the valve member moves under the action of fuel pressure. Again this form of nozzle is difficult to construct.

The object of the present invention is to provide a fuel injection nozzle of the kind specified in a simple and convenient form.

According to the invention a fuel injection nozzle of the kind specified comprises a tubular member slidable in the body and located about said valve member, said tubular member being axially movable relative to the valve member, means for limiting the extent of movement of the tubular member as the valve member is moved against the action of the resilient means, said tubular member defining the seating whereby when movement of the tubular member is halted the head is lifted from the seating to allow substantially unrestricted flow of fuel, said tubular member defining orifices which are uncovered to the exterior of the body during the initial movement of the valve member and tubular member against the action of the resilient means.

Examples of fuel injection nozzle will now be described with reference to the accompanying drawings in which.

Figure 1:
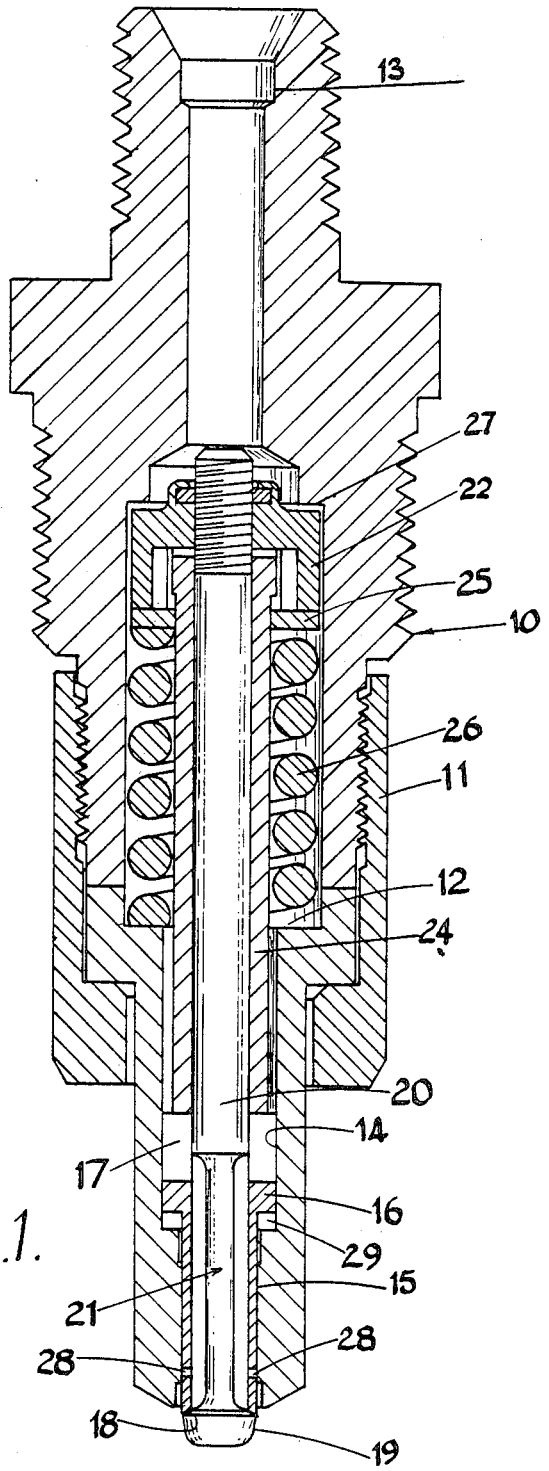
FIG. 1 is a sectional side elevation of one example of a nozzle.

Referring to FIG. 1 of the drawings, the nozzle comprises a two-part body generally indicated at 10, the two parts of the body being held in assembled relationship by means of a cap nut 11. Defined in the body is a chamber 12 to which fuel can be supplied under pressure by way of an inlet 13, from a fuel injection pump. Formed in the body is a stepped bore 14 which forms a continuation of the chamber and which opens out at the narrower end of the body. Slidable within the bore is a tubular member 15 which has a flange portion 16, the flange portion defining a pair of slots 17. At its end remote from the flange, the tubular member defines a seating 18 with which can engage a head 19 formed on a valve member 20 extending within the bore in the tubular member and projecting therefrom into the chamber. The valve member adjacent the head is provided with a reduced portion 21 which with the internal surface of the tubular member, defines an annular space which is in constant communication with the slots 17.

Figure 2:
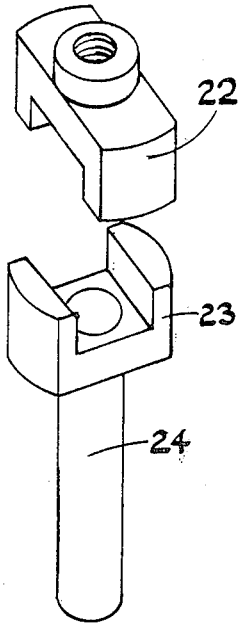
FIG. 2 is an exploded perspective view of two parts of the nozzle seen in FIG. 1.
Figure 3:
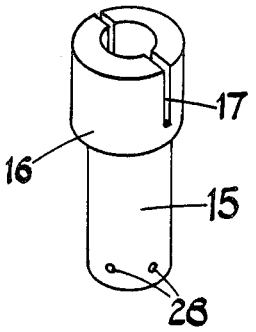
FIG. 3 is a perspective view of another part of the nozzle seen in FIG. 1.
Figure 4:
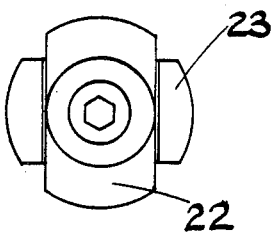
FIG. 4 is a plan view of part of the nozzle seen in FIG. 1.

The valve member at its end remote from the head, is provided with a peripheral screw thread with which is engaged a member 22 having a top hat section. A similar member 23 is provided upon a sleeve 24 which is located about the valve member and which abuts with the flanged end of the tubular member 15. As will be seen in FIG. 2, the members 22 and 23 while they are of top hat section, are not of annular form and the slots defined in the members are of such a width that the members can locate one within the other.

The walls of the member 22 engage an annular washer 25 the opposite face of which is engaged by one end of a coiled compression spring 26. The other end of the spring 26 engages a step defined at the end of the chamber 12.

In the closed position of the nozzle as illustrated in FIG. 1, the head 19 engages the seating at the end of the tubular member and the latter is in a retracted position, this position being determined by the abutment of the end surfaces of the walls of the member 23, with a step 27 defined at the end of the chamber.

Adjacent the end of the tubular member the latter is provided with apertures 28. The outer ends of the apertures 28 in the retracted position of the tubular member, are obturated by the wall of the bore and the inner ends of the apertures are in constant communication with the annular space defined between the inner surface of the tubular member and the reduced portion 21 of the valve member. The outer end of the bore 14 is of slightly enlarged diameter.

In operation, when fuel under pressure is supplied to the inlet 13, the pressure of fuel acts upon the effective end areas of the tubular member and the valve member and when the pressure is sufficient, the valve member and tubular member move together against the action of the spring 26. When sufficient movement has taken place, the apertures 28 are uncovered so that fuel can flow through the apertures. The areas of the apertures are comparatively small and hence good atomisation of the fuel is attained. As the pressure at the inlet continues to rise, a point will be reached at which the flange 16 engages a step 29 defined in the bore and when this occurs no further movement of the tubular member can take place. With increasing pressure however the valve member continues to move against the action of the spring 26 and the head 19 is lifted from the seating 18 to provide an annular area through which fuel can flow. The amount of movement of the valve member which can take place after the movement of the tubular member has been halted, is determined by the gap which exists between the base walls of the members 22 and 23. This gap can be adjusted by altering the position of the member 22 upon the valve member. Moreover, the pressure required to lift the valve member and tubular member against the action of the resilient means can be varied by providing a shim or shims between the member 22 and the annular member 25.

Figure 5:
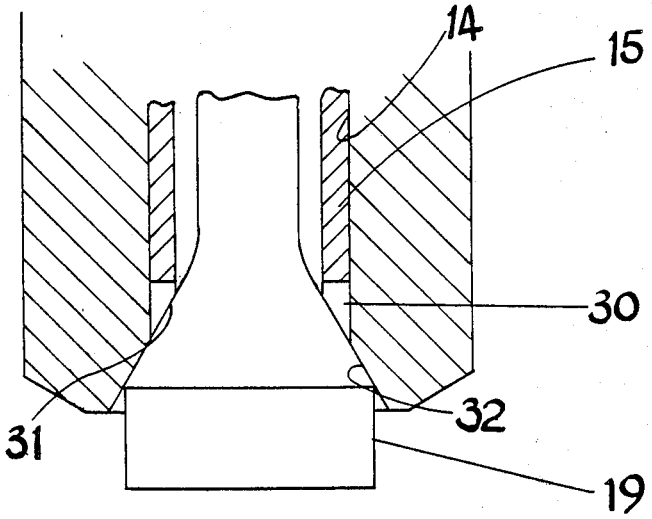
FIG. 5 is a sectional side elevation to an enlarged scale, of part of another example of the nozzle.

In the arrangement which is shown in FIG. 5, the tubular member instead of being provided with the apertures 28, has slots 30 formed in its end wall. Moreover, the end wall is shaped so that it forms a seating 31 with which the head 19 of the valve member can co-operate. The head also engages a further seating 32 defined by the body. In the closed position of the valve member as shown, the head engages the seatings 31 and 32 and as the pressure of fuel in the chamber increases, the valve member moves against the action of the spring and the slots 30 are exposed to permit restricted fuel flow. As in the example of FIG. 1, the movement of the tubular member 15 is limited by the step 29 and when this takes place further movement of the valve member lifts the valve head from the seating 31 to the permit substantially unrestricted flow of fuel. In this example the position of the parts when the nozzle is closed, is determined by the abutment of the valve head 19 with the seating 32.

The arrangements described provide a fuel injection nozzle having a varying orifice area so that proper atomisation of the fuel is obtained.

If the member 22 is tightened on the valve member so that the base walls of the members 22 and 23 are in engagement, the valve head 19 will be unable to move relative to the tubular member 15. The apertures 28 and the slots 30 will then constitute the only path for fuel flow through the nozzle. The slots vary in area as the valve assembly moves and in the case where apertures are provided these can be staggered so that the effective area of the path through which fuel can flow increases as the valve assembly moves against the action of the spring.

I claim:

1. A fuel injection nozzle for supplying fuel to an internal combustion engine comprising a body defining a chamber, a fuel inlet to said chamber, an outwardly opening valve member extending within said chamber, a head carried by the valve member for co-operation with a seating, resilient means located in the chamber and acting to urge the valve head into contact with the seating the arrangement being such that when fuel under pressure is supplied to said chamber, the pressure acting upon said valve member lifts the head from the seating to allow flow of fuel from said chamber in the form of a spray, a tubular member slidable in the body and located about said valve member, said tubular member being axially movable relative to the valve member, means for limiting the extent of movement of the tubular member as the valve member is moved against the action of the resilient means, said tubular member defining the seating whereby when movement of the tubular member is halted the head is lifted from the seating to allow substantially unrestricted flow of fuel, said tubular member defining orifices which are uncovered to the exterior of the body during the initial movement of the valve member and tubular member against the action of the resilient means.

2. A nozzle according to claim 1, in which said tubular member is slidable within a bore extending from said chamber to the exterior of the body, said orifices being covered by the wall of the bore in the closed position of the tubular member.

3. A nozzle according to claim 2, including a flange on the tubular member for co-operation with a step defined in said bore, the flange and the step forming the means for limiting the extent of movement of the tubular member as the valve member is moved against the action of the resilient means.

4. A nozzle according to claim 3, in which said orifices are defined by apertures in the wall of the tubular member.

5. A nozzle according to claim 3, in which said orifices are defined by axially extending slots in the wall of the tubular member, the end of the bore in the body remote from the chamber defining a further seating, said head of the valve member co-operating with the further seating in the closed position of the valve member.

6. A nozzle according to claim 4 or claim 5, including a member adjustably engaged with the valve member at its end remote from the head, said resilient means comprising a coiled compression spring one end of which is located against a step in the chamber and the other end of which is operatively connected to said valve member by way of said member.

7. A nozzle according to claim 6, including stop means for limiting the movement of the tubular member and valve member under the action of said spring.

8. A nozzle according to claim 7, in which said stop means comprises a further member operatively connected to said tubular member said further member co-operating with the end wall of the chamber to limit the extent of movement of the tubular member and valve member.

9. A nozzle according to claim 8, in which said member and said further member are of top hat section and are interengaged in opposed relationship, said further member being carried upon a sleeve located about the valve member and engaging the tubular member.

10. A nozzle according to claim 9, including a clearance defined between the opposed walls of said member and said further member, said clearance determining the further movement of the valve member relative to the tubular member when movement of the tubular member is halted by abutment of the flange with the step in the bore.

* * * * *